United States Patent [19]

MacDonald et al.

[11] Patent Number: 4,775,029

[45] Date of Patent: Oct. 4, 1988

[54] COLLAPSIBLE TOWER BOOM LIFT

[75] Inventors: Wayne P. MacDonald, McConnellsburg; John F. DeStefan, Waynesboro, both of Pa.

[73] Assignee: JLG Industries, Inc., McConnellsburg, Pa.

[21] Appl. No.: 105,747

[22] Filed: Oct. 8, 1987

[51] Int. Cl.[4] ..... B66F 11/04

[52] U.S. Cl. ..... 182/2; 52/117; 212/268; 212/261

[58] Field of Search ..... 182/2, 127, 65; 212/266, 255, 261, 268

[56] References Cited

U.S. PATENT DOCUMENTS

| | | | |
|---|---|---|---|
| Re. 31,400 | 10/1983 | Rallis et al. . | |
| 2,798,623 | 7/1957 | Girardi . | |
| 3,554,319 | 1/1971 | Smith et al. . | |
| 3,604,533 | 9/1971 | Eckels et al. . | |
| 3,637,043 | 1/1972 | Zwight | 182/2 |
| 3,708,037 | 1/1973 | Tranchero | 182/2 |
| 3,776,367 | 12/1973 | Grove . | |
| 3,777,845 | 12/1973 | Ashworth . | |
| 3,791,484 | 2/1974 | Harrison . | |
| 3,807,575 | 4/1974 | Merrick | 182/2 |
| 3,856,108 | 12/1974 | Grove . | |
| 3,866,713 | 2/1975 | Carpenter et al. . | |
| 4,019,604 | 4/1977 | Benson | 182/2 |
| 4,070,807 | 1/1978 | Smith, Jr. . | |
| 4,160,492 | 7/1979 | Johnston . | |
| 4,280,589 | 7/1981 | Merrick . | |
| 4,511,015 | 4/1985 | Purdy . | |
| 4,643,273 | 2/1987 | Stokoe . | |
| 4,646,875 | 3/1987 | Sholl | 182/2 |
| 4,667,771 | 5/1987 | Tranchero | 182/2 |

*Primary Examiner*—Reinaldo P. Machado

*Attorney, Agent, or Firm*—Foley & Lardner, Schwartz, Jeffery, Schwaab, Mack, Blumenthal & Evans

[57] ABSTRACT

A collapsible boom lift comprised of upper and lower telescoping boom assemblies. The upper boom is pivotally connected to an upright support member which is pivotally connected at its lower end to the lower boom. The upright support member is maintained plumb during raising and lowering of the lower boom, and the operator's platform, carried at the end of the upper boom, is maintained level during raising and lowering the upper boom. The upright support member is always positioned within the perimeter of the chassis of the boom lift.

10 Claims, 4 Drawing Sheets

COLLAPSIBLE TOWER BOOM LIFT

BACKGROUND OF THE INVENTION

The present invention relates as indicated to a collapsible tower boom lift, and relates more particularly to a tower boom lift in which the operator's platform can reach up to substantial heights while being maintained level with respect to the ground, while at the same time permitting the platform to reach over obstacles such as machine tools, piping, tanks, and other obstacles which are normally encountered in work environments of this type and encumber the operation of the boom lift.

In machines of this type, it is desirable that the upper boom and mountings therefor be able to swing without having any part of the turntable or boom elevating mechanism extend beyond the perimeter of the chassis. This arrangement permits the boom lift to operate within relatively narrow aisleway dimensions and prevent damage to equipment and materials positioned around the lift. Previously available boom lifts were frequently characterized by having operating parts of the boom elevating mechanism extend beyond the chassis, a condition called tailswing if the extension appears at the end of the chassis away from the operator, or underswing if the extension occurred on the end of the turntable closest to the operator. In those instances where tailswing or underswing were within desired parameters, the boom lift or aerial work platform was limited in the amount of height possible under the upper boom, even in work platforms where upper and lower boom assemblies were employed, thereby disadvantageously affecting or limiting the obtainable height of the work platform.

The following are examples of prior art boom lifts which exhibit the disadvantages referred to above. In U.S. Pat. No. 4,643,273 an access lift is comprised of extensible upper and lower boom assemblies. However, the operator cannot enter the platform until the lower boom is raised and locked, thereby eliminating a principle objective of equipment of this type, specifically, to provide a self-propelled machine which can be operated from the platform. This objective cannot be accomplished in the '273 patent due to the lack of any type of levelling system to maintain the platform attitude during operation of the lower boom. Moreover, tailswing is eliminated only after the lower boom has been raised, thereby requiring a much greater space within which to operate the equipment.

U.S. Pat. No. 4,280,589 discloses an extensible upper boom assembly operatively connected to parallel support arms in turn operatively connected to a post member secured to the turntable frame. The mounting arrangement for the support arms is such that the same problem of tailswing is encountered as referred to above. The same disadvantage exists in the self-propelled aerial lift disclosed in U.S. Pat. No. 4,160,492, which discloses a single extensible boom assembly operable from controls contained in the work platfrm.

Although U.S. Pat. No. Re. 31,400 discloses a self-propelled boom lift in which tailswing is eliminated, the single boom arrangement has obvious limitations in terms of the height attainable of the work platform.

SUMMARY OF THE INVENTION

With the above in mind, the principle objects of the present invention are to provide a tower boom lift in which there is zero tailswing or underswing, and wherein the lift is comprised of extensible telescopic lower and upper boom assemblies which permit maximum height of the work platform without creating obstructions.

In accordance with the invention, no part of the lower boom elevating mechanism, under any condition, extends beyond the confines of the chassis, and a relatively high "up and over" capability exists. This capability permits the lower boom to exceed 300% of the supporting chassis width.

The invention is further characterized by having a relatively low stowed height, approximately equal to the width of the chassis. Despite the substantially improved capabilities of the boom lift constructed in accordance with the present invention, the boom lift is characterized by relatively few moving parts and pivot points so that the operating platform can be continually maintained in a level position during ascent and descent.

An important feature of the invention is the provision of an upright support member pivotally connected at its lower end to the lower boom assembly and at its upper end to the upper boom assembly. The upright support member is maintained level or plumb during elevation of the lower boom, thereby permitting altitude adjustment of the operator's platform during swinging movement of the upper boom.

In the preferred embodiment, separate hydraulic circuits are provided, the first of which permits the upright support member to remain level regardless of the angle of the lower boom assembly relative to the ground. This circuit operates in tandem the hydraulic cylinders for raising the lower boom assembly and orienting the upright support member. In this manner, the upright support member is maintained level or plumb regardless of the angle of the lower boom assembly. Means are provided for precluding the telescoping of the sections of the lower boom assembly until the same has been raised, thus preventing tailswing. Similarly, the boom sections are telescoped in before the lower boom is lowered.

The second hydraulic circuit provides tandem operation of the hydraulic cylinder for elevating the upper boom assembly and the hydraulic cylinder for maintaining the work platform in a level position. The entire system functions to maintain a level or plumb, although movable, pivotal connection for the upper boom assembly, which is necessary to maintain the work platform level regardless of the angle of the upper boom assembly.

These and other objects of the invention will become apparent as the following description proceeds in particular reference to the application drawings.

DETAILED DESCRIPTION OF THE PREFERRED EMBODIMENTS

Figure 1:
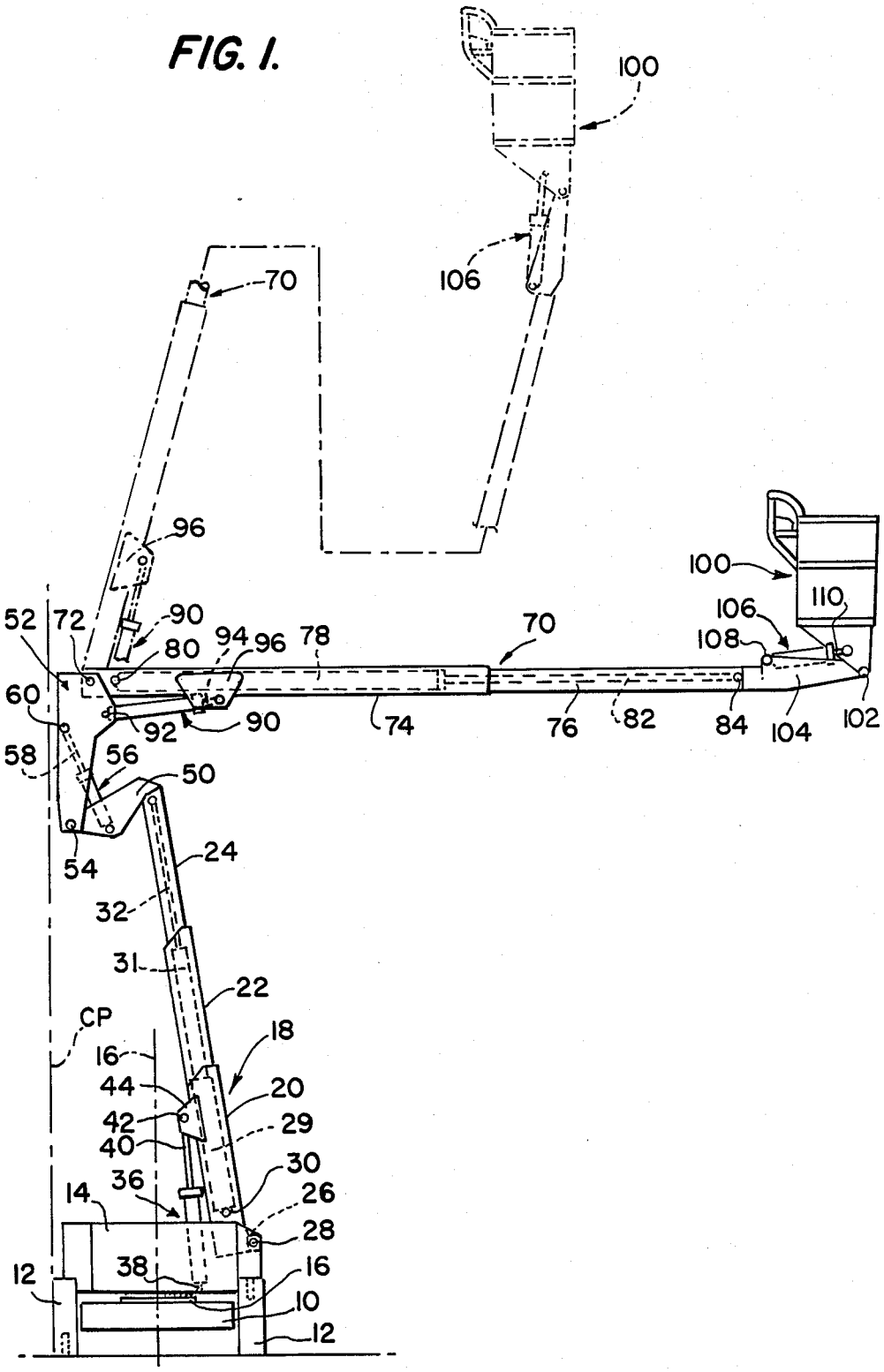
FIG. 1 is an end elevational view of the boom lift, showing the lower boom assembly elevated and the upper boom assembly in a lowered, generally horizontal position, and in a generally vertical or raised position.
Figure 2:
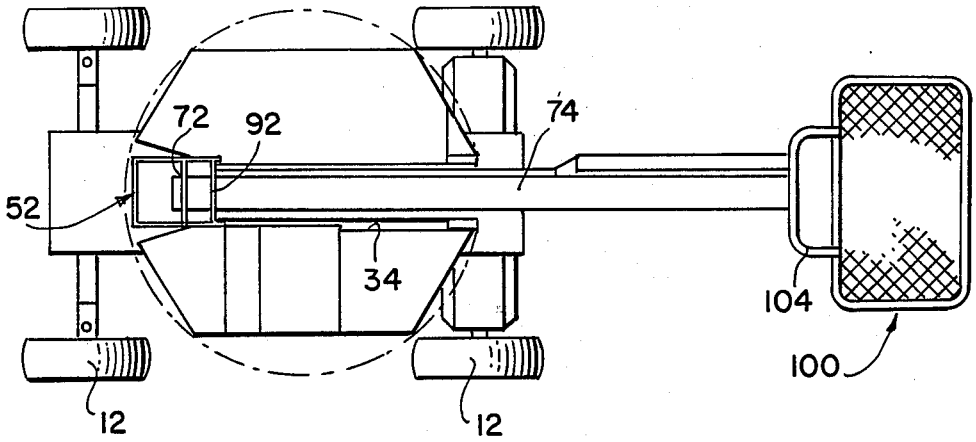
FIG. 2 is a top plan view of the boom lift, with both the upper and lower boom assemblies being shown collapsed.
Figure 3:
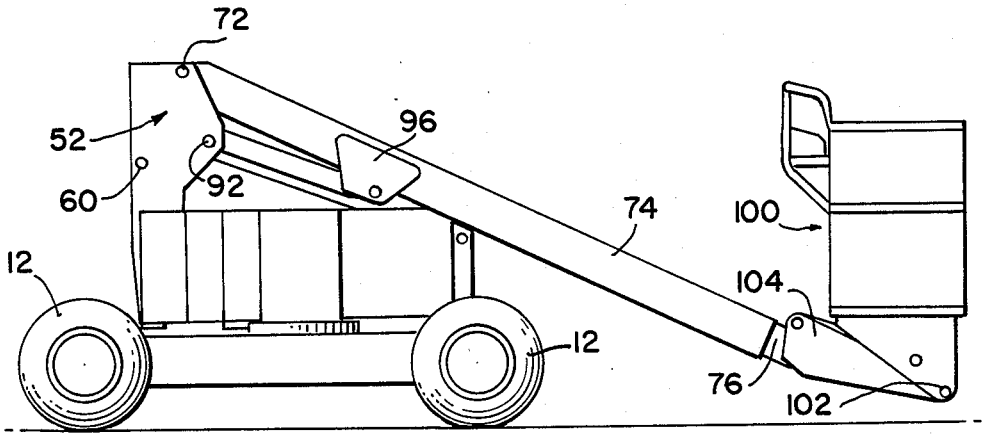
FIG. 3 is a side elevational view of the boom lift showing the upper and lower boom assemblies collapsed as shown in FIG. 2.

Referring now in detail to the application drawings, wherein like parts are designated by like reference numerals, and initially to FIGS. 1–3, the boom lift is mounted on a conventional chassis 10 mounted on wheels commonly designated at 12 to provide self-propulsion for the boom lift, all in a well-known manner. A turntable 14 is attached to the chassis by a large diameter vertical axis bearing 16 to permit rotation of the turntable about a center line of rotation 16. The turntable 14 has mounted thereon stabilizing counterweight sufficient in weight and location to permit rotation of the turntable without tailswing or underswing.

The fly or lower boom generally indicated at 18 is comprised of telescoping sections 20, 22 and 24. The lower boom section 20 is provided with a laterally extending flange or projection 26 which is apertured to receive a pin 28, the opposite ends of which are journalled in openings provided therefore in the turntable to accommodate swinging movement of the lower boom. A hydraulic cylinder 29 is positioned within the lower boom section 20 and is pinned thereto as shown at 29. The cylinder 29 includes piston sections 31 and 32 pinned or otherwise connected to the telescopic sections for extending the sections when the boom is raised. The lower boom 18 is shown fully telescoped out in FIG. 1, and when telescoped in by the hydraulic cylinder 29, it is pivotable about pin 26 to a lowered, stowed position as shown in FIG. 3, with the chassis being formed with a longitudinal channel 34 (FIG. 2) to accommodate the lower boom section 20. The lower boom per se and the means for telescoping the same inwardly and outwardly is per se well-known, and forms no part of the present invention.

A hydraulic lower lift cylinder generally indicated at 36 is mounted at its lower end, for example by pin 38, to the turntable 14, with the piston 40 of the cylinder being pinned at 42 to a pair of parallel spaced plates 44 rigidly secured to the lower boom section 20. By means of cylinder 36, the lower boom 18 can be swung from its stowed position as shown in FIG. 3 to its fully raised position as shown in FIG. 1.

A laterally extending connecting member 50 comprised of spaced sides and a bottom web is rigidly mounted to the upper boom section 24 for movement therewith. Since forces above the connecting member are transmitted therethrough, it is imperative that the connection of the member 50 to the boom section 24 be strong and rigid, and welding is preferred. An upright support member generally indicated at 52, also comprised of two sides and a connecting web, with the sides extending outwardly of the sides of the connecting member 50, is pivotally connected to the connecting member 50 by pin 54. A lower level cylinder 56 is mounted at its lower end to the connecting member 50, with the piston 58 of the cylinder being connected to the upright member 52 by pin 60 or other suitable means. Movement of the piston 58 inwardly or outwardly of the cylinder 56 can therefore pivot the upright member 52 about the axis of pin 54 relative to the connecting member 50 and the top section 24 of the lower boom. It is important that the pivotable upright 52 remain plumb or vertical regardless of the angle of the lower boom 18 relative to the ground. This is accomplished by jointly actuating the lower lift hydraulic cylinder 36 and the lower level cylinder 56 by means of the hydraulic system illustrated in FIG. 4 and referred to in greater detail below. It is also important to maintain the upright support member 52 level so that a stable pivot can be provided for the upper boom and the operator's platform secured at the end thereof.

It will be noted that in the fully extended condition of the lower boom 18 as shown in FIG. 1, the upright member 52 remains inside a vertical chassis plane CP through the outer surface of the wheels 12 shown at the left in FIG. 1. The mounting of the upright 52 to the boom 18 and the coordinated control of the cylinders 36 and 56, as will be hereinafter described, functions to maintain the upright member within the chassis plane CP.

The upper boom is generally indicated at 70 and is pivotally mounted as shown at pin 72 to the upper portion of the upright support member 52. The upper boom is comprised of boom sections 74 and 76, with the latter being telescoped inwardly or outwardly of the former. Hydraulic cylinder 78 is secured, for example, by pin 80, to the boom section 74, with the piston 82 of the cylinder being pinned at its outer end as shown at 84 to the outer boom section 76. Although two boom sections have been shown in FIG. 1, it will be apparent that further sections could be provided if desired, as shown in the lower boom 18.

A hydraulic upper lift cylinder generally indicated at 90 is pivoted at its inner end, for example, by pin 92, to the upright member 52, with the piston 94 of the cylinder being secured to parallel plates 96 rigidly secured to the inner boom section 74. In this manner, the upper boom 70 may be raised about the axis through pin 72 from the generally horizontal position as shown in FIG. 1, or a position below horizontal as shown in FIG. 3, to a raised, generally vertical position shown in the same figure.

A work or operator's platform generally indicated at 100 is pivotally mounted at its lower end by pin 102 or the like to a connecting member 104 rigidly mounted on the outer boom section 76. A platform or upper level cylinder 106 is mounted to the member 104, for example, by pin 108, with piston rod 110 of the cylinder being pinned to the platform 100. The platform level cylinder controls the orientation of the platform relative to the upper boom 70, maintaining the platform level (generally vertical) regardless of the angle of the upper boom relative to a reference point, for example, the ground. Thus, when the upper boom 70 is raised, the platform is maintained generally vertical throughout by extension of the piston rod 110. When the upper boom is raised, the cylinder 106 is actuated in response to actuation of the upper lift cylinder 90, as will be further described in detail when particular reference is made to FIG. 5.

The upright support member 52 maintains its FIG. 1 position throughout the angle of movement of the upper boom 70. Thus, when the lower boom is fully extended and fully raised, and when the upper boom is likewise fully extended and raised, the upright support member 52 remains within the chassis plane CP. This arrangement maintains the stability of the entire structure, despite the substantially greater heights obtainable due to the structure described. Although FIG. 1 orients the upright support 52 with respect to the vertical chassis plane CP which is parallel to a longitudinal plane through the center of rotation 16, it will be understood that such relationship will also be maintained with regard to vertical planes extending through the rear and front edges of the supporting wheels, reference being made to FIG. 3. This relationship will also be understood from FIG. 2 wherein the turntable is rotated 90° from its FIG. 1 position. Dashed lines are shown in FIG. 2 to indicate 90° rotation from FIG. 2, with the outermost points of each dashed line being within the outer planes of the wheels.

Despite the heights obtained by the boom lift of the present invention, and the continued stability afforded by virtue of the construction and interconnection of the upright support member to the upper and lower booms, the boom lift when collapsed results in a machine of very limited height, reference being made to FIG. 3. The height of the lift above the chassis is essentially equal to the height of the upright member 52, assuming that the upper boom 70 is lowered to an angle below horizontal as shown in FIG. 3.

Figure 4:
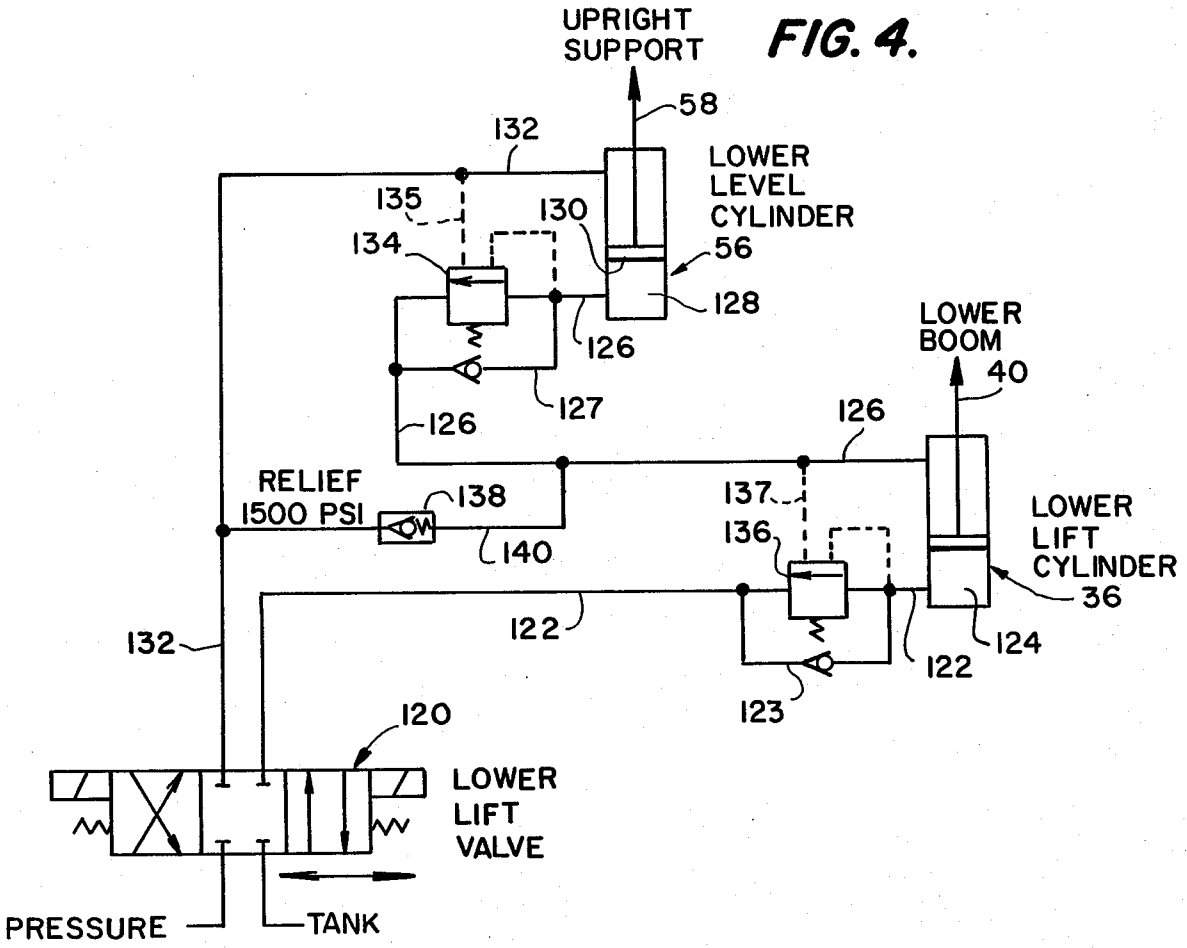
FIG. 4 is a schematic diagram of the hydraulic circuit for operating in tandem the lower lift hydraulic cylinder and the lower level hydraulic cylinder for leveling the upright support member.

Reference is made to FIG. 4, which illustrates diagrammatically the hydraulic circuit for controlling the lower lift cylinder 36 and the lower level cylinder 56. A lower lift control valve 120 serves to control hydraulic fluid flow to and from the lower lift cylinder 36 and the lower level cylinder 56, and to and from a source of pressurized fluid and a storage tank.

The hydraulic circuit of FIG. 4 functions to raise or lower the lower boom 18 and, as above described, it is important that the upright support member 52 be maintained plumb throughout the elevation cycle of the lower boom. The circuit can best be described by reference to the sequence which occurs when the lower boom is elevated. The lower lift control valve 120 is shown diagrammatically in FIG. 4, and when the spool of the control valve is shifted toward the right as viewed in that figure, pressurized oil is directed through line 122 and bypass 123 to the piston chamber 124 of the lower lift cylinder 36. As the piston 40 is forced outwardly to raise the lower boom, oil is forced from the rod end of the lower lift cylinder through line 126 and bypass 127 into the piston chamber 128 of the lower level cylinder 56. This forces the piston 130 to be raised in the cylinder thereby extending the piston rod 58 which is pivotally connected to the upright member 52 (see FIG. 1). As the piston 130 advances upwardly, oil is forced from the rod end of the lower level cylinder through line 132 to the tank through the lower lift control valve 120. The size and geometric relationship of the lower lift cylinder 36 and the lower level cylinder 56 is such that the piston rod 58 of the lower level cylinder 56 continually extends from the cylinder an amount proportional to the elevation of the lower boom, whereby the upright member 52 is kept plumb or level.

When the lower boom 18 is lowered (after the boom sections have been telescoped in), the spool of the lower lift control valve 120 is shifted toward the left thereby directing oil under pressure into the rod end of the lower level cylinder 56. The resultant pressure buildup in line 32 and the rod chamber above the piston pilots or forces open the overcenter valve 134 through line 135, thereby allowing oil to flow from the piston end 128 through the overcenter valve 134 and then through line 126 to the rod end of the lower lift cylinder 36. This causes the piston of the lower lift cylinder to move downwardly (as shown in FIG. 4), with the build up of pressure in line 126 and the rod chamber, resulting in the opening of a lower lift cylinder overcenter valve 136 through line 137. This permits flow from the chamber 124 through the valve 136 and line 122 to the tank through the control valve 120. Thus, during lowering of the lower boom, the actuation of the lower lift cylinder 36 is responsive to actuation of the lower level cylinder 56.

A relief valve 138 operable at 1500 p.s.i. is positioned in line 140 extending between lines 126 and 132. The relief valve allows oil to bypass the lower level cylinder 56 in instances where the lower level cylinder bottoms out before the lower lift cylinder 36 is completely retracted, whereby the lower boom can still be lowered its full extent.

Figure 5:
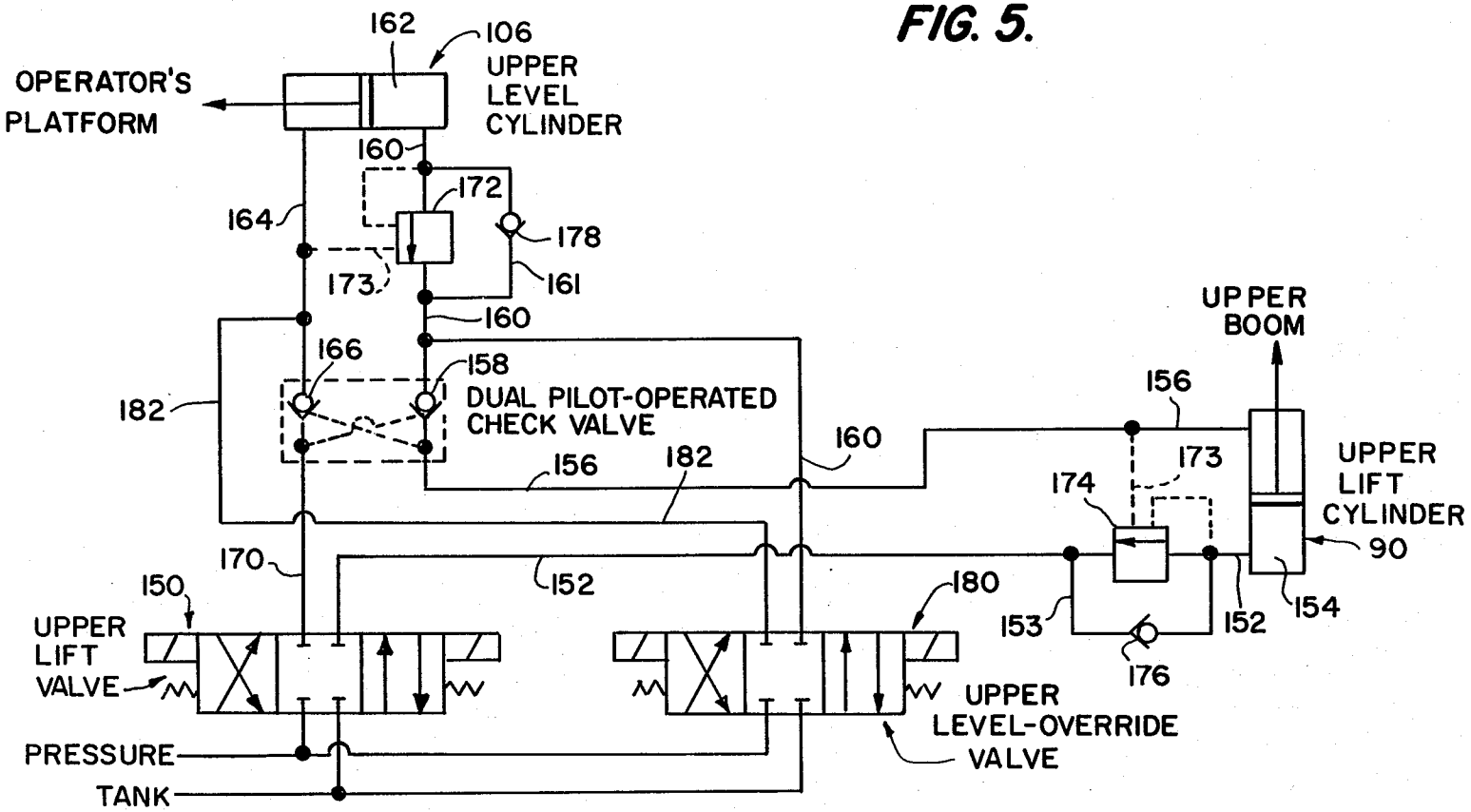
FIG. 5 is a schematic diagram of the hydraulic circuit for operating in tandem the upper lift hydraulic cylinder for elevating the upper boom assembly, and the upper level hydraulic cylinder for maintaining the work platform in a level position.

Reference is now made to FIG. 5, which schematically illustrates the hydraulic circuit for the coordinated actuation of the upper lift cylinder 90 and the upper or platform level cylinder 106. The latter is directly pivotally connected to the operator's platform 100, and the upper lift cylinder 90 controls the raising and lowering of the upper boom 70.

When elevating the upper boom from its generally horizontal to its generally vertical positions as shown in FIG. 1, the spool in the upper lift control valve generally indicated at 150 is shifted toward the right thereby permitting oil under pressure to flow through line 152 and bypass 153 into the piston chamber 154 of the upper lift cylinder 90. This causes the piston to move upwardly in the cylinder thereby raising the upper boom.

As the piston moves upwardly in the upper lift cylinder 90, oil is forced through the rod end of the cylinder into line 156, through check valve 158, and line 160 and bypass 161 into the piston chamber 162 of the upper level cylinder 106. The upper lift cylinder 90 and upper level cylinder 106 thus move in tandem and effect simultaneous movement of the upper boom and operator's platform. The cylinder displacement of the respective cylinders 90 and 106, and the positioning of the piston rod of the upper level cylinder relative to the operator's platform 100 is such that the platform remains horizontal throughout the entire elevational cycle of the upper boom.

As the piston expands (moves to the left as seen in FIG. 5) under pressure in the piston chamber of the upper level cylinder 106, oil is forced from the rod end of the cylinder and through line 164 to check valve 166, which is piloted open due to the pressure in the line 164. The oil then returns to the tank through the upper lift control valve 150.

To lower the upper boom 70, the spool of the upper lift control valve 150 is shifted toward the left thereby causing oil under pressure to flow through line 170, check valve 166, and line 164 into the rod end of the upper level cylinder 106. The pressure in line 64 opens the overcenter valve 172 through line 173. The pilot operated check valve 158 is also opened. Oil under pressure thereby flows from the piston chamber 162 of the upper level cylinder 106 through the valves indicated, and through line 156 to the rod end chamber of the upper lift cylinder 90. This forces the piston in the cylinder 90 downwardly, in the orientation shown in FIG. 5, and the force of the pressurized fluid in the rod chamber and in line 156 serves to pilot open, through line 173, the overcenter valve 174, through which the oil flows to the tank through the upper lift control valve 150.

It will thus be seen that the upper lift cylinder 90 and the upper level cylinder 106 act in complete tandem and dependence one upon the other. When the upper boom 70 is raised, the operator's platform is immediately reoriented by the upper level cylinder 106 to maintain the platform level. When the upper boom is lowered, the upper level cylinder 106 is first actuated which similarly effects simultaneous actuation of the upper lift cylinder 90 to lower the boom.

It may in certain instances be desirable to move the operator's platform from a level or plumb position while the boom is elevated, without raising or lowering the upper boom. To accomplish this, an upper level override valve 180 is provided, similar in construction to the upper lift valve 150 and connected to upper level cylinder 106 and to pressure and tank. When the upper level override valve 180 is shifted to the right, as viewed in FIG. 5, oil under pressure flows through line 160, bypass line 161 containing the check valve 178, and into the piston chamber 162 of the upper level cylinder 106, thereby moving the piston outwardly of the cylinder and effecting corresponding movement of the platform about the axis of pivotal movement thereof. Oil forced out of the rod end chamber of the upper level cylinder 106 returns to the tank through line 164 and bypass line 182, which bypasses the check valve 166, and then to the tank through the override valve 180.

When the override valve 180 is shifted to the left, the oil under pressure flows through line 164 and bypass line 182 into the chamber at the rod end of the upper level cylinder 106, thereby moving the piston inwardly, or to the right as viewed in FIG. 5. Oil is forced out of piston chamber 162 of the upper level cylinder 106, through line 160, overcenter valve 172, and override valve 180 back to the tank.

It will be noted that the dual pilot check valves 158 and 166 isolate the separate movement of the upper lift cylinder by the override valve 180 from operation of the upper lift cylinder so that the upper boom position is maintained if adjustment of the operator's platform from a level position is desired.

It will be apparent from the foregoing description that the principal objectives of the invention have been achieved. The lift boom has a relatively high "up and over" capability, while at the same time keeping the lower boom elevating mechanism under all conditions of adjustment within the confines of the chassis. The raising or lowering of the lower boom is always in tandem with the upright member interconnecting the lower and upper boom thereby maintaining the upright member in a level or plumb position. In a generally similar manner, the raising or lowering of the upper boom is accomplished in coordination with the orienting of the operator's platform so as to maintain the latter at a level position regardless of the angle of elevation of the upper boom. All of these important features are accomplished while at the same time providing a boom lift having a relatively low stowed height for convenience of transportation, and having relatively few moving parts and pivot points for maintaining the operator's platform in a level position.

What is claimed is:

1. A collapsible tower boom lift, comprising:

(a) a chassis;

(b) a turntable rotatably mounted on said chassis;

(c) a lower boom comprised of at least two telescoping boom sections, and means for pivotally mounting the lower end of said boom on said turntable within the perimeter of said chassis;

(d) means for raising and lowering said lower boom;

(e) an upper boom comprised of at least two telescoping boom sections;

(f) upright support means positioned between and pivotally connected to the innermost section of said upper boom and the outermost section of said lower boom whereby both said upper and lower booms are raised and lowered relative to said upright support means, said upright support means always being within the perimeter of the chassis regardless of the angles of elevation of said booms;

(g) means for raising and lowering said upper boom;

(h) an operator's platform pivotally connected to the outermost boom section of said upper boom, and (i) control means for maintaining said upright support means and said operator's platform in level positions regardless of the angle of elevational movement of said lower and upper booms.

2. The boom lift of claim 1 wherein said means for raising and lowering said lower boom comprises a lower lift cylinder pivotally attached at its cylinder end to said turntable and at its piston end to the lowermost section of the lower boom.

3. The boom lift of claim 2 wherein said control means for maintaining said upright support means in a level position comprises a hydraulic cylinder mounted at its cylinder end to the outermost section of said lower boom, and mounted at its piston end to said upright support means.

4. The combination of claim 3 wherein said control means further includes hydraulic circuit means including a lower lift control valve for directing oil under pressure first to said hydraulic cylinder for raising said lower boom and then directly to said hydraulic cylinder for controlling the position of said upright support means, the sizing and positioning of the respective hydraulic cylinders being such that during raising or lowering movement of said lower boom, said upright support means is maintained in a level position within the perimeter of said chassis.

5. The boom lift of claim 1 wherein said means for raising and lowering said upper boom comprises an upper lift cylinder, the cylinder end of which is pivotally connected to said upright support means and the rod end of which is pivotally attached to the innermost section of said upper boom.

6. The apparatus of claim 5 wherein said control means for maintaining said operator's platform in a level position comprises an hydraulic upper level cylinder, the cylinder end of which is attached to the outermost section of said upper boom and the piston of which is pivotally attached to said platform.

7. The boom lift of claim 6 wherein said control means further includes an hydraulic circuit including an upper lift control valve for delivering oil under pressure substantially simultaneously to said upper lift cylinder and said upper level cylinder whereby said upper level cylinder maintains said operator's platform in a level position in response to the raising or lowering of said upper boom by said upper lift cylinder.

8. The boom lift of claim 7 further including an upper level override control valve in fluid flow communication with said upper level cylinder and a source of pressurized oil, said upper level override control valve permitting said upper level cylinder, and consequently said operator's platform, to be moved from a level position said upper boom is elevated, said upper level override control valve being isolated from said upper lift cylinder so that said boom is maintained in its elevated position during in such independent movement of said operator's platform.

9. The boom lift of claim 1 wherein said lower boom includes three telescopic boom sections, and separate hydraulic cylinder means for extending or retracting said boom sections, said separate hydraulic cylinder means being inoperable to telescope out the lower boom sections unless the lower boom is fully elevated, and being inoperable to lower said lower boom until all of said boom sections have been telescoped in, whereby said boom sections of said lower boom are always contained within the perimeter of said chassis.

10. The boom lift of claim 9 wherein the outermost boom section of said lower boom has rigidly secured thereto a connecting means the outer end of which is pivotally attached to said upright support means relatively adjacent the bottom thereof, and wherein said control means for maintaining said upright support means in a level position comprises a lower level hydraulic cylinder mounted at its cylinder end to said connecting member and at its piston end to said upright support means.

* * * * *